US007025045B2

(12) United States Patent
Hlousek

(10) Patent No.: US 7,025,045 B2
(45) Date of Patent: Apr. 11, 2006

(54) DEVICE FOR INJECTING FUEL TO STATIONARY INTERNAL COMBUSTION ENGINES

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/477,235

(22) PCT Filed: Jan. 20, 2003

(86) PCT No.: PCT/DE03/00139

§ 371 (c)(1),
(2), (4) Date: May 12, 2004

(87) PCT Pub. No.: WO03/076794

PCT Pub. Date: Sep. 18, 2003

(65) Prior Publication Data

US 2004/0187848 A1 Sep. 30, 2004

(30) Foreign Application Priority Data

Mar. 8, 2002 (DE) ..... 102 10 282

(51) Int. Cl.
*F02M 37/04* (2006.01)

(52) U.S. Cl. ..... 123/447; 123/467

(58) Field of Classification Search ..... 123/447, 123/446, 467, 456, 468, 469; 239/89–96, 239/600

See application file for complete search history.

(56) References Cited

U.S. PATENT DOCUMENTS

| | | | | |
|---|---|---|---|---|
| 4,161,161 | A * | 7/1979 | Bastenhof | 123/447 |
| 4,662,315 | A | 5/1987 | Sommer | |
| 4,719,889 | A * | 1/1988 | Amann et al. | 123/447 |
| 4,796,577 | A * | 1/1989 | Baranescu | 123/300 |
| 5,012,786 | A * | 5/1991 | Voss | 123/467 |
| 5,095,876 | A | 3/1992 | Yonekawa et al. | |
| 5,511,528 | A * | 4/1996 | Iwanaga et al. | 123/467 |
| 5,904,300 | A | 5/1999 | Augustin | |
| 6,220,224 | B1 | 4/2001 | Matthies | |
| 6,425,539 | B1 | 7/2002 | Boecking | |
| 6,446,608 | B1 | 9/2002 | Rizk | |
| 6,595,188 | B1 * | 7/2003 | Forck et al. | 123/446 |

FOREIGN PATENT DOCUMENTS

| | | |
|---|---|---|
| DE | 2 237 666 | 3/1973 |
| DE | 31 19 050 A1 | 11/1982 |
| DE | 35 05 229 A1 | 8/1986 |

(Continued)

*Primary Examiner*—Carl S. Miller
(74) *Attorney, Agent, or Firm*—Ronald E. Greigg

(57) ABSTRACT

The invention relates to a fuel injection system for use in internal combustion engines having delivery units for delivering fuel from a fuel reservoir in order to supply at least one high-pressure line to the cylinders of the engine. The at least one high-pressure line supplies a number of fuel injectors, which each include an injector nozzle that supplies fuel to a combustion chamber of the engine and includes line segments that connect the individual fuel injectors to one another. The injector bodies of the fuel injectors each have an accumulator chamber integrated into them.

13 Claims, 7 Drawing Sheets

FOREIGN PATENT DOCUMENTS

| | | | |
|---|---|---|---|
| DE | 40 30 490 | A1 | 4/1991 |
| DE | 42 38 727 | A1 | 5/1994 |
| DE | 197 12 135 | C1 | 8/1998 |
| DE | 198 37 332 | A1 | 2/2000 |
| DE | 198 42 067 | | 3/2000 |
| DE | 696 06 463 | T2 | 12/2000 |
| DE | 199 41 688 | A1 | 3/2001 |
| DE | 199 47 196 | A1 | 4/2001 |
| DE | 100 26 286 | | 12/2001 |
| GB | 1 372 775 | | 11/1974 |
| GB | 2 097 858 | A | 11/1982 |
| GB | 2 272 747 | A | 5/1994 |
| GB | 2 356 668 | A | 5/2001 |
| JP | 2000205081 | | 7/2000 |

* cited by examiner

Fig. 7
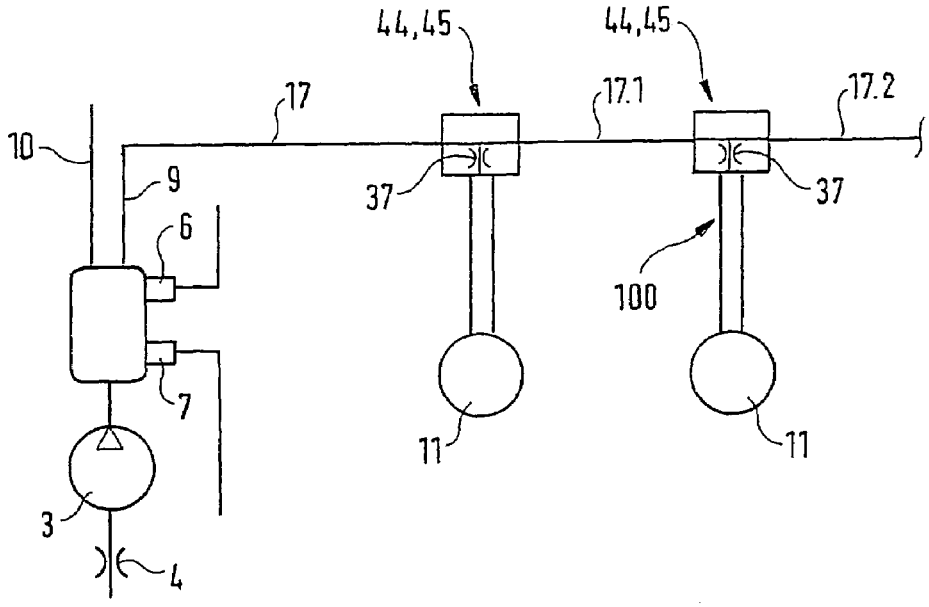
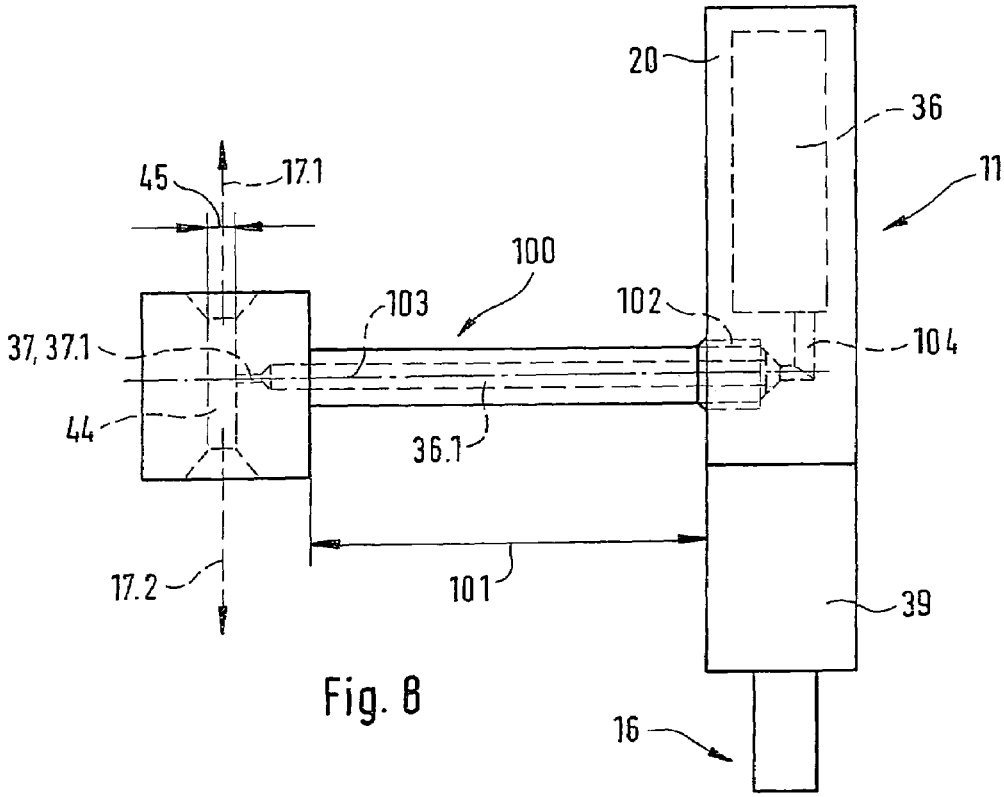
Fig. 8

47
11
20
36
100
103
106
36.1
102
14
35
43
46
105
33
29
39
21

DEVICE FOR INJECTING FUEL TO STATIONARY INTERNAL COMBUSTION ENGINES

CROSS-REFERENCE TO RELATED APPLICATIONS

This application is a 35 USC 371 application of PCT/DE 03/00139 filed on Jan. 20, 2003.

BACKGROUND OF THE INVENTION

1. Field of the Invention

Internal combustion engines that are used as vehicle motors, stationary motors (generator motors), or for propelling ships as a rule have between 2 and 20 cylinders. In these engines, the bore diameter of the respective cylinders lies within a broad spectrum, sometimes reaching 500 mm in large diesel engines. Depending on the number of cylinders, individually customized fuel injection systems are used, which must be individually tailored to the number of cylinders.

2. Description of the Prior Art

DE 198 37 332 A1 relates to a control unit for controlling the buildup of pressure in a pump unit. The control unit has a control valve with a valve-actuating unit connected to it. The control valve is embodied as an I-valve that opens inward in the flow direction and has a valve body that is supported so that it can slide axially in the housing of the control unit and when the control valve is closed, rests against a valve seat of the control valve from the inside. A throttle device is provided, which throttles the flow through the control valve when the control valve is opened by a small stroke h. When the control valve is opened by this stroke distance, the valve seat is still open, but another valve seat embodied on the control valve is closed so that the medium supplied via the throttle bores flows through the control valve. As a result of such a throttled flow through the control valve, at first a lower pressure is built up in a high-pressure region of the system. When the control valve is completely closed, however, both the first valve seat and the additional valve seat are closed, which interrupts the bypass connection. This causes a high pressure to build up between the pump unit and the low-pressure region of the system, in comparison to the high-pressure region.

DE 42 38 727 A1 relates to a solenoid valve used to control the passageway of a connection between a low-pressure chamber and a high-pressure chamber that is at least sometimes brought to a high fluid pressure, in particular that of a pump working chamber of a fuel injection pump. A valve body is provided, which is inserted into a valve housing and contains a bore in which a valve closing member in the form of a piston can be moved by an electromagnetic counter to the force of a return spring. Starting from a circular, cylindrical circumferential surface, the piston tapers down to a reduced diameter by means of a conical surface; the conical surface cooperates with a conical valve seat, which is disposed on the valve body and connects a high-pressure chamber encompassing the circular cylindrical circumferential surface of the piston to a low pressure chamber encompassing the reduced diameter of the piston. The cone angle of this valve seat is embodied as smaller than the cone angle of conical surface of the piston so that the piston cooperates with the valve seat associated with it by means of a sealing edge produced at the transition between its cylindrical circumferential surface and the conical surface. In the overflow direction from the high-pressure chamber to the low-pressure chamber, the sealing edge has a throttle restriction disposed downstream of it, whose action comes into play at the beginning of the opening stroke. This throttle restriction is formed by means of a throttle passage in the overlap region between the angled surface of the piston and a valve seat surface, in which the angle of the conical surface of the piston is slightly greater, for example 0.5° to 1° greater, than the angle of the valve seat surface so that at the beginning of the opening stroke, the flow cross section between the conical surface of the piston and the valve seat surface decreases steadily over the entire circumference in the overflow direction toward the low-pressure chamber. Because of the high flow speeds of the fuel between the injection phases—whether these be preinjection, main injection, or secondary injection phases—this design cannot completely eliminate cavitation defects.

SUMMARY OF INVENTION

The advantages of the embodiment according to the invention lie primarily in the fact that an injector design principle can be used regardless of the number of cylinders in the internal combustion engine and regardless of the motor configuration (V-pattern, W-pattern, in-line pattern) by virtue of the fact that instead of a rail component, the high-pressure supply line segments are used to connect decentralized accumulators. The high-pressure supply line segments, in turn, connect the individual injectors to one another; they are interchangeable and can be adapted to various cylinder distances of the cylinders in the individual cylinder banks of the internal combustion engine. The proposed embodiment offers an increased flexibility in the design of an injection system and can be easily adapted to different motor configurations, regardless of whether the cylinders are arranged in a V-pattern, W-pattern, or in-line pattern.

The modularity principle is also achieved in the design of the fuel injector used. The components used in these injectors include injection nozzles, intermediate plates with inlet and outlet throttles integrated into them, valve units, and injector bodies. By replacing the intermediate plate, for example, the pressure relief or pressure impingement of the control chamber of the injector can be influenced through the dimensioning of the throttle cross sections and can be adapted to an extremely wide variety of circumstances in which the injector is used. The injector body used in the modularly designed injector can be embodied in various lengths and can consequently be optimally adapted to the space available. The injector body includes an accumulator chamber whose accumulator volume is smaller, for example, than 80 times the maximally injected quantity of fuel. Highly pressurized fuel acts on this accumulator by means of an inlet throttle embodied in the head region of the fuel injector. Downstream of the accumulator integrated into the injector body, a flow limiter is provided, which limits the flow rate of fuel to the nozzle chamber. The inlet throttle to the accumulator in the head region of the injector is preferably designed to allow a multiple injection without pressure pulsations being produced in the high-pressure line segments that are connected to the head region of the fuel injector. This also leaves undisturbed the stable pressure level in the accumulators of the other fuel injectors. The inlet throttle can advantageously keep the pressure in the accumulator chamber integrated into the injector body at a pressure level that corresponds to the pressure level prevailing in a pressure accumulator integrated into one of the supply units.

Thanks to the small distance between the accumulator and the nozzle, the pressure pulsations in this accumulator and between the accumulator and the nozzle are considerably less intense than in conventional injection systems.

The accumulator chambers integrated into the injector bodies, their inlet throttles, and an accumulator chamber integrated into one of the supply units or disposed in the vicinity of them, render the respective injection events independent of the motor configuration of the engine, the length of the high-pressure line segments, and the number of cylinders in the engine. Due to the centralized disposition of the accumulator for damping pump pulsations, the injection system can be used in a large number of differently configured engines and consequently considerably reduces the large variety of components required. The accumulator chamber associated with the supply units and the pressure accumulators associated with the injectors are connected to one another by means of simple high-pressure line segments, which are modularly designed and can therefore be easily interchanged, which considerably simplifies the adaptation of the injection system to an extremely wide variety of internal combustion engine configurations and renders the quality of the injection events independent of the line length of the line segments connecting the accumulator chambers to one another.

BRIEF DESCRIPTION OF THE DRAWINGS

The invention will be explained in detail below in conjunction with the drawings, in which:

FIG. 8 shows a schematic diagram of the high-pressure connecting piece.

DESCRIPTION OF THE PREFERRED EMBODIMENTS

Figure 1:
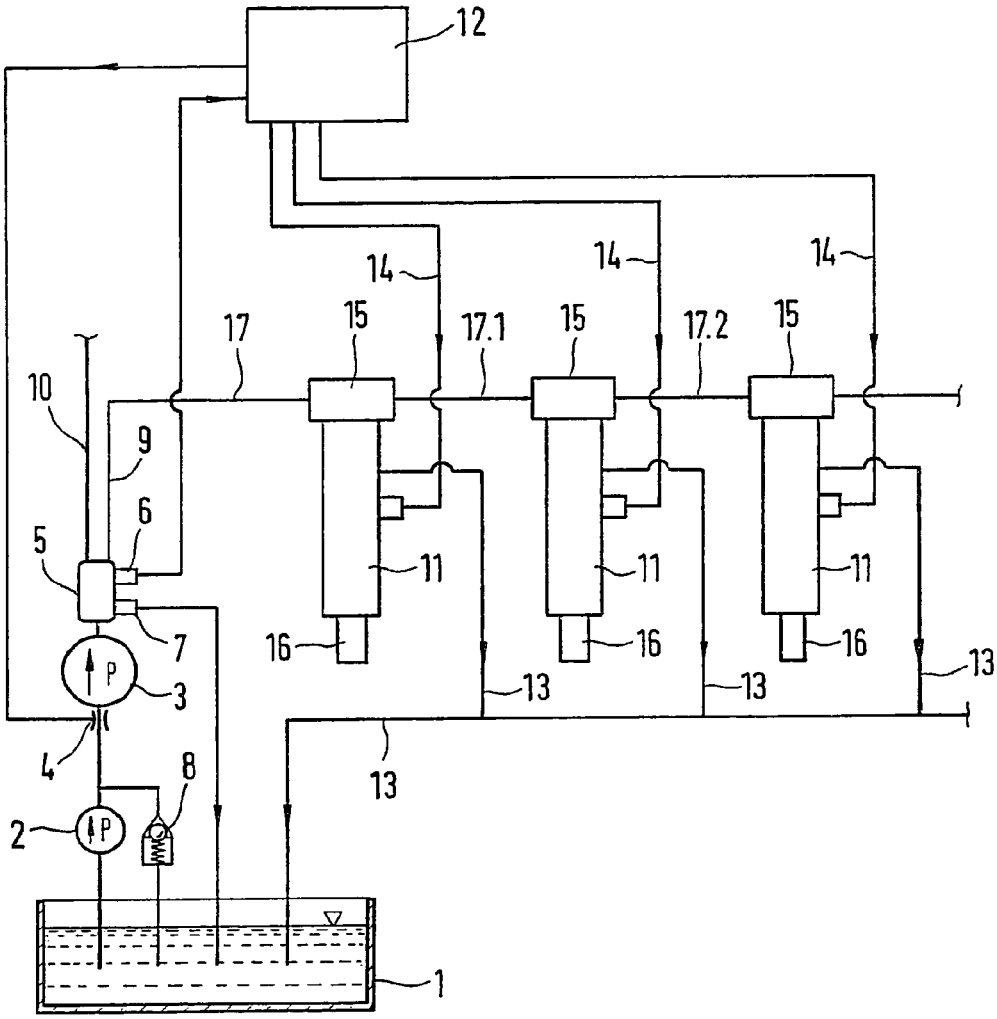
FIG. 1 shows the components of an injection system.

The injection system shown in FIG. 1, which is for supplying fuel to an internal combustion engine, includes a fuel reservoir 1. A fuel-supply pump 2 delivers fuel from the fuel reservoir 1. On the pressure side, the fuel-supply pump 2 has a high-pressure pump unit 3 connected downstream of it, which is preceded by a throttle restriction 4. The throttle restriction 4 is designed to be variable and can be triggered by means of a control unit 12. The fuel-supply pump 2 has a pressure control valve 8 connected downstream of it, which controls the supply pressure to the high-pressure pump unit 3 and is connected to the fuel reservoir 1.

The high-pressure pump unit 3 includes an integrated pressure accumulator 5. A pressure relief valve 7 whose outlet feeds into the fuel reservoir 1 protects the pressure accumulator 5. The integrated pressure accumulator 5 also has a pressure sensor 6, which is connected to the control unit 12 and is used to report the pressure prevailing in the integrated pressure accumulator 5 to the control unit 12. A first high-pressure line 9 branches off from the integrated pressure accumulator 5. The first high-pressure line 9 can supply highly pressurized fuel to the injectors 11, for example, of the cylinders of a first cylinder bank of an internal combustion engine. This configuration of an injection system is chosen, for example, when supplying fuel to cylinders in an in-line internal combustion engine. In addition, other high-pressure lines can branch off from the integrated pressure accumulator 5. In the depiction in FIG. 1, another high-pressure line 10 is schematically indicated, which is for supplying the injectors 11 of cylinders of another cylinder bank of an internal combustion engine; the cylinders of such an engine can be arranged in a V-pattern. In addition, a third high-pressure line not shown in FIG. 1 can branch off to a third cylinder bank, for example in engines whose cylinders are arranged in a W-pattern and therefore include three or more cylinder banks.

The first high-pressure line 9 leading away from the integrated pressure accumulator 5 transitions into a first line segment 17. The line segment 17 is connected to the head region 15 of the injector 11. The head region 15 of the injector 11, whose end oriented toward the combustion chamber has an injector nozzle 16 connected to it, has a first line segment 17.1 branching off from it, which is connected to the head region 15 of another injector 11. The head region 15 of this other injector 11 has another line segment 17.2 branching off from it, leading to the head region 15 of the next injector 11. Depending on the number of cylinders in a cylinder bank of an engine, the sequence of the line segments 17, 17.1, 17.2 can continue with further injectors 11, not shown here, for injecting fuel into the cylinders of the engine. The individual injectors 11 for supplying fuel to the combustion chambers of an engine are each electronically triggered by the control unit 12 via triggering mechanisms 14. The individual injectors 11 are connected via low-pressure line segments 13 to a collecting line, which supplies the leakage quantity or control quantities of the injectors on the low-pressure side to the fuel reservoir 1. The injectors 11 of a second and third cylinder bank—which are not shown in FIG. 1 —are similarly connected on the low-pressure side via low-pressure lines 13 to the fuel reservoir 1 into which the leakage or diversion quantities of the injectors 11 are supplied.

Figure 2:
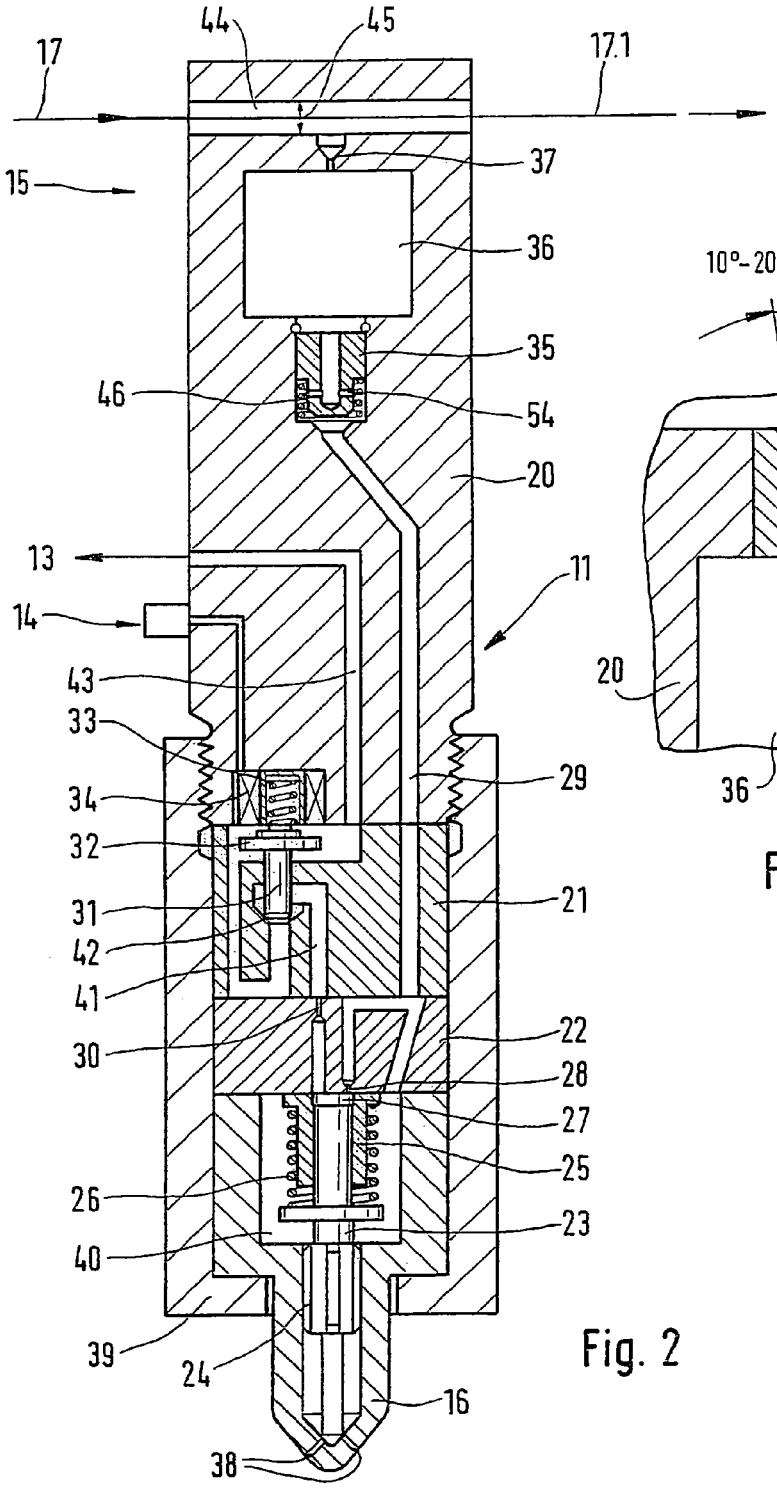
FIG. 2 shows the design principle of a fuel injector of the injection system from FIG. 1.

FIG. 2 shows the design principle of an injector, which is used in injection systems of the kind depicted in FIG. 1. It can be inferred from FIG. 2 that the injector 11 has an injector body 12, a control part 21, an intermediate plate 22, and an injector nozzle 16 at the combustion chamber end.

The injector nozzle 16 has a nozzle needle 23, which is disposed so that it can move in the vertical direction. The nozzle needle 23 includes a needle guide 24 in which individual open flow surfaces are provided, which are distributed offset from one another in the circumferential direction in relation to the nozzle needle 23; via these flow surfaces, fuel flows from a nozzle needle chamber 40 to the tip of the nozzle needle, remains there, and when the nozzle needle 23 moves vertically upward, is injected into the combustion chamber of the engine via one or more injection openings 38.

The nozzle needle 23 includes a collar (unnumbered) against which a spring 26 is supported. The spring 26 acts against an upper collar of a sleeve-shaped component 25, which is pressed against the underside of the intermediate plate 22 by the spring 26 that is supported against the collar of the nozzle needle 23. The sleeve-shaped component 25 and the upper end surface of the nozzle needle 23 delimit a control chamber 27 whose pressure impingement or pressure relief is produced by the vertical movement of the nozzle needle 23 inside the nozzle body. On the one hand, the nozzle chamber 27 is acted on with highly pressurized fuel by means of an inlet throttle 28 embodied in the intermediate plate, via a high-pressure fuel line 29. On the other hand, the control chamber 27 is pressure-relieved via an outlet throttle element 30 likewise embodied in the intermediate plate 22. In order to relieve the pressure in the control chamber 27, the control part 21 is provided with a valve 31, which is actuated by an actuator 34 embodied in the injector body 20. The actuator 34 is embodied as an annular magnet in the schematic diagram according to FIG. 2 and is triggered by the control unit 12 via the triggering mechanism 14. The valve 31 is provided with an armature-like valve plate 32, which a spring element 33 encompassed by the electromagnet 34 pushes into its seat 42 embodied in the control part 21. When the seat 42 is closed, i.e. when the actuator 34 is inoperative, an outlet conduit 41 downstream of the outlet throttle 30 of the control chamber 27 is closed. Under the valve seat 42 of the valve 31 in the control part 21, there is a meandering outlet conduit, which communicates with an outlet conduit 43 that is embodied in the injector body 20. A diverted fuel volume flows via the outlet conduit 43 into the lines 13 provided on the low-pressure side (see depiction in FIG. 1).

The injector body 20 of the fuel injector 11 contains an accumulator chamber 36. The accumulator volume in the accumulator chamber 36 is less than 80 times the maximal injection quantity, which is injected via the injection openings 38 in the injector nozzle 16 into a combustion chamber of an internal combustion engine, not shown in FIG. 2. Preferably, the accumulator volume of the accumulator chamber 36 is 60 to 80 times the injection quantity. The accumulator chamber 36 in the head region 15 of the injector body 20 is acted on with highly pressurized fuel via an inlet throttle 37. The inlet throttle 37, in turn, branches off from a conduit 44 likewise provided in the head region of the injector body 20. The conduit 44 is in turn acted on by highly pressurized fuel via the line segment 17 of the high-pressure supply line 9; at the other end, the conduit 44 in the head region 15 of the injector body 20 communicates via the first line segment 17.1 with another head region 15, not shown here, of another fuel injector 11. The conduit cross section of the conduit 44 in the head region 15 of the injector 20 is labeled with the reference numeral 45. The line segment 17 of the high-pressure line 9 therefore connects the pressure accumulator 5 integrated into the high-pressure pump unit 3 and—with the interposition of the inlet throttle 37—the pressure accumulator 36 inside the injector body 20. The dimensioning of the inlet throttle 37 between the conduit 44 in the head region 15 of the injector body 20 and the injector accumulator chamber 36 assures the independence of the individual injection events regardless of the number of cylinders of the engine and regardless of its motor configuration, whether it is arranged in an in-line pattern, a V-pattern, or a W-pattern, and regardless of the lengths of the individual connecting lines in relation to one another. Furthermore, a suitable design of the inlet throttle 37 to the accumulator chamber 36 in the injector body 20 allows a number of injection events to be executed in sequence without pressure pulsations occurring in the accumulator chamber 36 and in the line segments 17 and 17.1, thus also influencing other fuel injectors 11. This permits preinjection, main injection, and secondary injection phases to be executed without pressure pulsations. The inlet throttle 37 to the accumulator chamber 36 permits a virtually identical pressure level to be maintained in the accumulator chamber 36 before the injection event and in the integrated pressure accumulator 5 of the high-pressure pump unit 3. The throttle geometry of the inlet throttle 37 to the accumulator chamber is advantageously embodied with different flow coefficients, as can be inferred from the depiction in FIG. 2*a*, see reference numeral 37.1.

The accumulator chamber 36 in the injector body 20 of the fuel injector 11 has a flow limiter 35 connected downstream of it. The body of the flow limiter 35 contains a lateral bore with a throttling action 54 and is prestressed by means of a spring element 46. The flow limiter 35 is situated downstream of the accumulator chamber 36 and upstream of the high-pressure fuel line 29 of the injector body 20. The flow limiter 35 prevents an undesirable excess quantity in the event of a malfunction, for example when there is a leak in the nozzle, or limits it in such a way that the influx of an undesirable excess quantity is only possible during an injection event. The body of the flow limiter is provided with a lateral bore 54 extending perpendicular to the symmetry axis of the body of the flow limiter 35; the bottom region of the body of the flow limiter is closed so that an outflow of fuel only occurs via the openings of the lateral bore 54 in the wall of the body of the flow limiter 35. The high-pressure fuel line 29 connected to the flow limiter 35 in the injector body 20 extends through the control part 21, upstream of where the high-pressure fuel line 29 feeds into a two-branched conduit in the intermediate plate 22. One branch of the conduit in the intermediate plate 22 extends in the inlet throttle 28 in order to exert pressure on the control chamber 27, while the other branch of the conduit feeds into a nozzle needle chamber 40. Fuel passes via the nozzle needle chamber 40 and the open flow surfaces embodied in the needle guide 24, into the annular chamber encompassing the nozzle needle 23 underneath the needle guide 24, and—assuming a corresponding vertical stroke motion of the nozzle needle 23—is injected into the combustion chamber of an internal combustion engine, not shown, via the injection openings 38.

The modularly designed fuel injector 11, including an injector body 20, a control part 21, the intermediate plate 22, and an injector nozzle 16, is mounted with the aid of a nozzle-retaining nut 39 embodied as a union nut. The modular design advantageously facilitates exchanging the intermediate plate 22, in which the inlet throttle 28 and the outlet throttle 30 are embodied, for another intermediate plate 22 of the same structural height, in which the inlet throttle 28 and the outlet throttle 30 that relieves the pressure in the control chamber 27 are embodied with larger or smaller diametrical geometries. Consequently, simply exchanging the modularly embodied intermediate plate 22 permits a different pressure buildup or pressure relief behavior to be set in the triggering chamber 27 and a resulting stroke characteristic curve to be set for the nozzle needle 23. The advantage offered by the modular design of the fuel injector 11 according to the schematic diagram in FIG. 2 is that of making advantageous use of the space available in the head region of an internal combustion engine, by offering the possibility of designing the injector body 20 differently, with various structural heights.

Figure 2A:
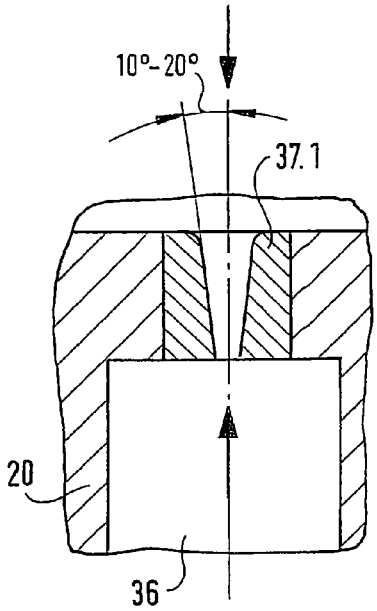
FIG. 2*a* is an enlarged depiction of the throttle geometry of the inlet throttle to the accumulator chamber.

As seen in FIG. 2*a*, shows an enlarged depiction of the throttle geometry of an inlet throttle restriction to the accumulator chamber, the inlet throttle 37 advantageously has a rounded inlet at the end oriented toward the line segments 17, 17.1, which facilitates an influx of fuel into the accumulator chamber 36. The throttle bore of the inlet throttle 37 narrows continuously toward the point at which it feeds into the accumulator chamber 36. The angle at which the cross sectional reduction tapers conically in the direction toward the accumulator chamber 36 preferably lies in a range between 10° and 20° in relation to the symmetry axis of the throttle bore of the inlet throttle 37. At the mouth of the inlet throttle 37 into the accumulator chamber 36, the throttle bore is embodied with sharp edges, which counteracts a reflux of fuel via the inlet throttle 37 into the conduit 44 between the line seaments 17, 17.1.

The inlet throttle 37 advantageously has a rounded inlet at the end oriented toward the line segments 17,17.1, which facilitates an influx of fuel into the accumulator chamber 36. The throttle bore of the inlet throttle 37 narrows continuously toward the point at which it feeds into the accumulator chamber 36. The angle at which the cross sectional reduction tapers conically in the direction toward the accumulator chamber 36 preferably lies in a range between 10° and 20° in relation to the symmetry axis of the throttle bore of the inlet throttle 37. At the mouth of the inlet throttle 37 into the accumulator chamber 36, the throttle bore is embodied with sharp edges, which counteracts a reflux of fuel via the inlet throttle 37 into the conduit 44 between the line segments 17,17.1.

Figure 3:
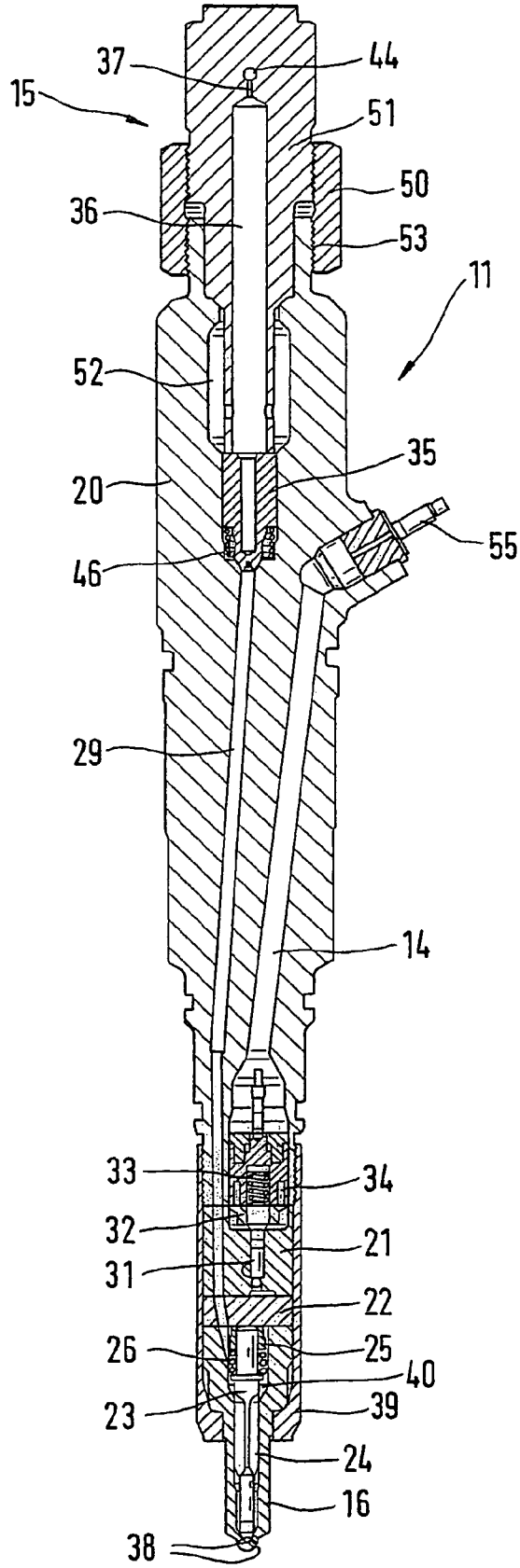
FIG. 3 shows a longitudinal section through an exemplary embodiment of an injector according to FIG. 2.

FIG. 3 shows a longitudinal section through an exemplary embodiment of the fuel injector according to FIG. 2., in which: in the head region 15 of the injector, an insert piece 51 is screwed together with the injector body 20 by means of a retaining nut. Perpendicular to the plane of the drawing, the conduit 44 extends in the insert piece 51 and is connected to the accumulator chamber 36 via an inlet bore throttle 37. The insert piece 51 protrudes with its lower region into a cavity 52 embodied in the injector body 20 and acts on it via two openings provided in the wall of the insert piece 51. The insert piece 51 is adjoined on its underside by the flow limiter 35 (see the schematic diagram in FIG. 2), which is connected downstream of the accumulator chamber 36 and upstream of the high-pressure fuel line 29. The screw connection between the retaining nut 50 and the stop of the injector body 20 is labeled with the reference numeral 53. The high-pressure fuel line 29 extends slightly inclined through the injector body 20 and transitions into a corresponding bore segment in the control part 21, passes through the intermediate plate 22, and then feeds into the nozzle chamber 40 of the injector nozzle 16. In the injector nozzle 16, the nozzle needle 23 is guided so that it can move vertically in a needle guide 24. A spring element 26 exerts pressure on the nozzle needle 23. The control part 21 of the injector configuration according to FIG. 3 contains the valve 31, whose valve plate 32 can be moved in the vertical direction by means of an actuator 34 embodied in the form of an annular magnet. The annular magnet 34 encompasses the closing spring 33 that acts on the valve 31 in the direction of its closed position; the electromagnet 34 of the actuator, which actuates the valve 31, is triggered via connecting lines 14, which extend through the injector body 20 essentially in the vertical direction; the corresponding connecting piece 55 is provided on the side of the injector body 20 and is embodied as a plug contact. The nozzle-retaining nut 39 encompassing the injector nozzle 16 also accommodates the intermediate plate 22 and the control part 21 that contains the actuatable valve 31. The nozzle-retaining nut 39 and the lower end of the injector body 20 are screwed to each other. In the exemplary embodiment of the fuel injector 11 according to FIG. 3 as well, the intermediate plate 22 contains both the inlet throttle 28, which exerts pressure on a control chamber 27, and the outlet throttle 30, which relieves the pressure of the control chamber 27, but these are not shown in FIG. 3, see the schematic depiction according to FIG. 2.

In the exemplary embodiment of the fuel injector according to FIG. 3, in the head region 15 of the injector, an insert piece 51 is screwed together with the injector body 20 by means of a retaining nut. Perpendicular to the plane of the drawing, the conduit 44 extends in the insert piece 51 and is connected to the accumulator chamber 36 via an inlet bore throttle 37. The insert piece 51 protrudes with its lower region into a cavity 52 embodied in the injector body 20 and acts on it via two openings provided in the wall of the insert piece 51. The insert piece 51 is adjoined on its underside by the flow limiter 35 (see the schematic diagram in FIG. 2), which is connected downstream of the accumulator chamber 36 and upstream of the high-pressure fuel line 29. The screw connection between the retaining nut 50 and the stop of the injector body 20 is labeled with the reference numeral 53. The high-pressure fuel line 29 extends slightly inclined through the injector body 20 and transitions into a corresponding bore segment in the control part 21, passes through the intermediate plate 22, and then the high-pressure fuel line 29 feeds into the nozzle chamber 40 of the injector nozzle 16. In the injector nozzle 16, the nozzle needle 23 is guided so that it can move vertically in a needle guide 24. A spring element 26 exerts pressure on the nozzle needle 23. The control part 21 of the injector configuration according to FIG. 3 contains the valve 31, whose valve plate 32 can be moved in the vertical direction by means of an actuator 34 embodied in the form of an annular magnet. The annular magnet 34 encompasses the closing spring 33 that acts on the valve 31 in the direction of its closed position; the electromagnet 34 of the actuator, which actuates the valve 31, is triggered via connecting lines 14, which extend through the injector body 20 essentially in the vertical direction; the corresponding connecting piece 55 is provided on the side of the injector body 20 and is embodied as a plug contact. The nozzle-retaining nut 39 encompassing the injector nozzle 16 also accommodates the intermediate plate 22 and the control part 21 that contains the actuatable valve 31. The nozzle-retaining nut 39 and the lower end of the injector body 20 are screwed to each other. In the exemplary embodiment of the fuel injector 11 according to FIG. 3 as well, the intermediate plate 22 contains both the inlet throttle 28, which exerts pressure on a control chamber 27, and the outlet throttle 30, which relieves the pressure of the control chamber 27, but these are not shown in FIG. 3, see the schematic depiction according to FIG. 2.

Figure 4:
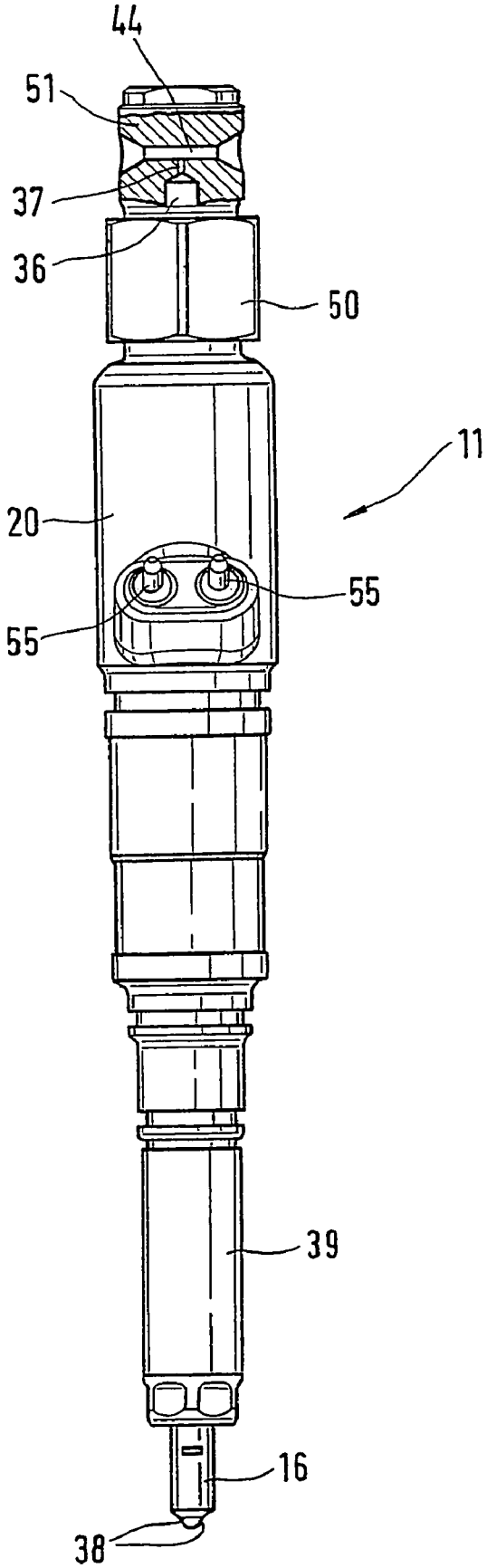
FIG. 4 shows a top view of the exemplary embodiment of the injector according to FIG. 3.

In the head region 15 of the fuel injector 11 according to the depiction in FIG. 4, the insert piece 51 is shown in a partially sectional view. The line segments 17 and 17.1 of the first high-pressure line 9 shown in FIGS. 1 and 2 are connected to the bevels of the conduit 44 that extend at an angle. The inlet throttle 37 branches off from the conduit 44 in the insert piece 51 and serves to act on the accumulator chamber 36 embodied in the insert piece 51 with highly pressurized fuel. The insert piece 51 and the injector body 20 of the fuel injector 11 are screwed to each other by means of a retaining nut 50. The top view according to FIG. 4 shows the plug connections 55 for triggering an actuator, which is embodied for example as an electromagnet and can be accommodated inside the injector body 20. A reference numeral indicates the nozzle-retaining nut 39, which contains the injector nozzle 16, the intermediate plate 22 disposed above it, and the control part 21 and, by means of the internal thread at its upper end, mounts these components to the combustion chamber end of the injector body 20. The fuel is injected from injection openings labeled with the reference numeral 38 into the combustion chambers of the engine, regardless of whether its cylinders are arranged in an in-line pattern, a V-pattern, or a W-pattern.

Figure 5:
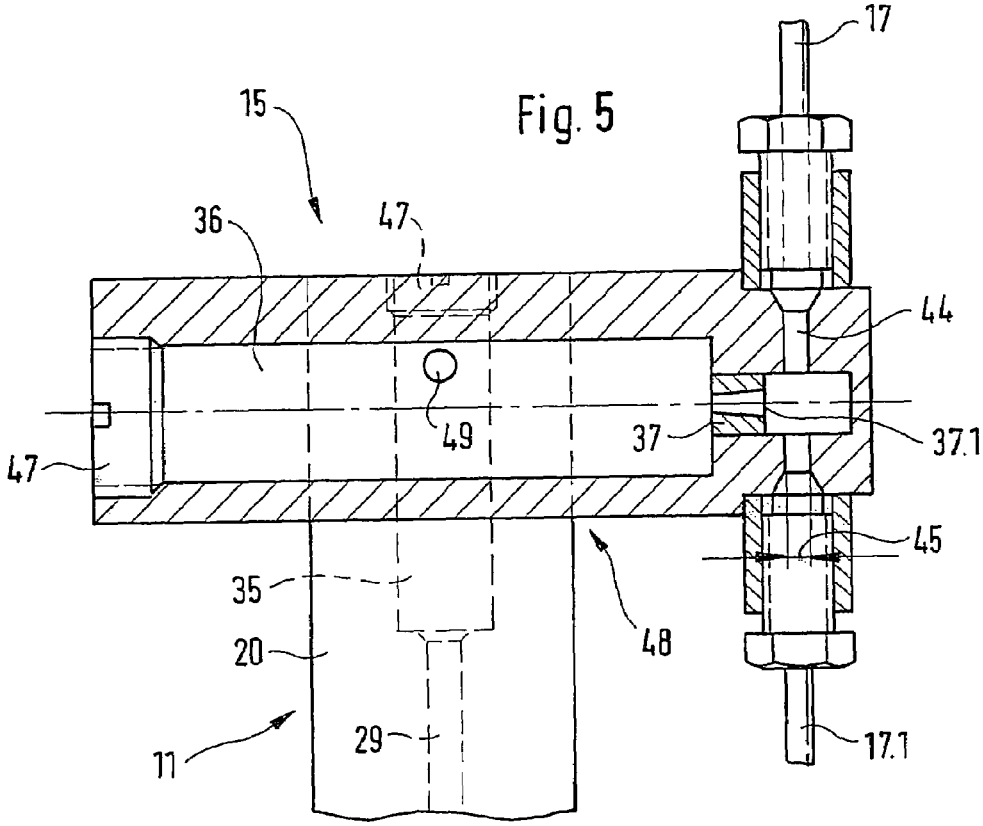
FIG. 5 shows a top view of an exemplary embodiment of the fuel injector, with a laterally constructed accumulator chamber.

FIG. 5 shows a fragmentary view, partially in section, of an exemplary embodiment of the fuel injector with a laterally constructed accumulator chamber. The conduit 44, which is embodied with the conduit cross section 45, extends through the housing of the accumulator chamber 36, between the line segment 17 and the first line segment 17.1. The conduits, which are spaced apart by a cavity in the housing of the accumulator chamber 36, feed into this cavity, which has an inlet throttle body 37 incorporated into it. At its end oriented toward the above-mentioned cavity, the body of the inlet throttle 37 has a flow-promoting throttle geometry 37.1 and can be rounded at the inlet point. According to the throttle geometry shown in an enlarged depiction in FIG. 2*a*, the throttle conduit can have a cross section that continuously narrows from the infeed point into the accumulator chamber 36, with the wall of the throttle bore inside the throttle body 37 extending at an angle between 10° and 20° in relation to the center line of the throttle bore. The accumulator chamber, which is accommodated in a lateral orientation 48 in the head region 15 of the fuel injector 11 shown in the exemplary embodiment according to FIG. 5, is closed in a pressure-tight manner by means of a stopper 47, which can be embodied, for example, as a screw element. The flow limiter 35, whose design is indicated with dashed lines here, communicates via a conduit 49 with the interior of the accumulator chamber 36 incorporated in the lateral direction 48. Fuel flows via the conduit 49 from the interior of the accumulator chamber 36 to the flow limiter that regulates the flow of fuel in the direction through the high-pressure fuel line 29 to the injection nozzle of the fuel injector 11.

The conduit 44, which is embodied with the conduit cross section 45, extends through the housing of the accumulator chamber 36, between the line segment 17 and the first line segment 17.1. The conduits, which are spaced apart by a cavity in the housing of the accumulator chamber 36, feed into this cavity, which has an inlet throttle body 37 incorporated into it. At its end oriented toward the above-mentioned cavity, the body of the inlet throttle 37 has a flow-promoting throttle geometry 37.1 and can be rounded at the inlet point. According to the throttle geometry shown in an enlarged depiction in FIG. 2*a*, the throttle conduit can have a cross section that continuously narrows from the infeed point into the accumulator chamber 36, with the wall of the throttle bore inside the throttle body 37 extending at an angle between 10° and 20° in relation to the center line of the throttle bore. The accumulator chamber, which is accommodated in a lateral orientation 48 in the head region 15 of the fuel injector 11 shown in the exemplary embodiment according to FIG. 5, is closed in a pressure-tight manner by means of a stopper 47, which can be embodied, for example, as a screw element. The flow limiter 35, whose design is indicated with dashed lines here, communicates via a conduit 49 with the interior of the accumulator chamber 36 incorporated in the lateral direction 48. Fuel flows via the conduit 49 from the interior of the accumulator chamber 36 to the flow limiter that regulates the flow of fuel in the direction through the high-pressure fuel line 29 to the injection nozzle of the fuel injector 11.

Figure 6:
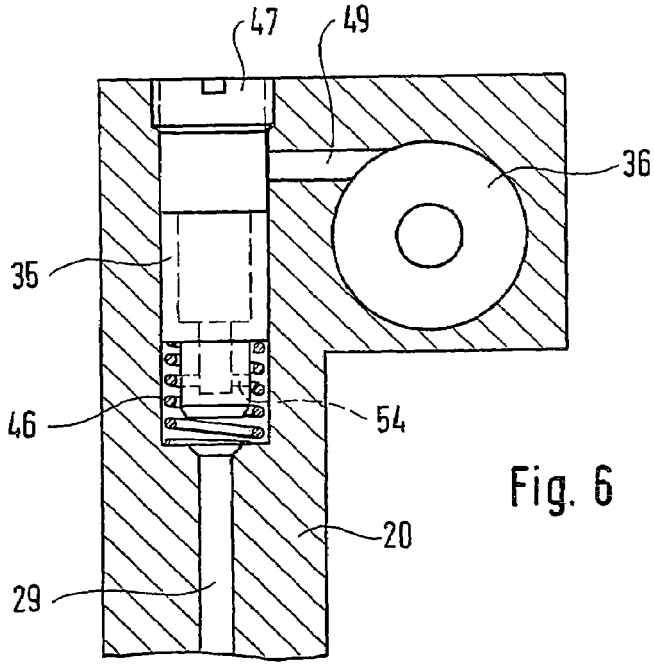
FIG. 6 shows a section through the exemplary embodiment according to FIG. 5, FIG. 7 schematically depicts another exemplary embodiment, with a high-pressure connecting piece as part of the injector.

FIG. 6 shows a sectional view of the exemplary embodiment of the fuel injector according to FIG. 5, with the accumulator chamber installed in the lateral direction. It can be inferred from the depiction in FIG. 6 that for strength reasons, the conduit 49 connecting the accumulator chamber 36 to the flow limiter 35 branches tangentially from the circumference of the accumulator chamber 36 in order to reduce material-fatiguing pressure loads on the material of the injector body 20. Above the flow limiter 35, the injector body 20 is sealed in a pressure-tight manner by a screw stopper 47. The screw stopper 47 facilitates easy installation of the spring 46 that acts on the flow limiter 35, which spring is inserted into the interior of the injector body 20 above the high-pressure fuel line 29. Analogous to the depiction of the flow limiter in FIG. 2, the flow limiter 35 depicted in FIG. 6 likewise has a lateral bore 54 and, analogous to the depiction of the flow limiter 35 in the exemplary embodiment of the design proposed according to the invention, is prestressed by a spring element 46 embodied as a spiral spring.

FIG. 7 schematically depicts another exemplary embodiment, with a high-pressure connecting piece as part of an injector body. By contrast with the exemplary embodiment of the injection system for larger autoignition internal combustion engines shown in FIG. 1, according to the schematic diagram shown in FIG. 7, the inlet throttles 37 do not act directly on the fuel injectors 11 via the conduits 44 extending in the head regions 15 of the injectors, between the line segments 17, 17.1, and 17.2. A high-pressure line connecting piece 100 extends between the inlet throttles 37 which are preferably embodied with a geometry shown in enlarged fashion in FIG. 2*a*, and the fuel injectors 11. This high-pressure line connecting piece 100, essentially embodied as a tubular body with a thick wall, acts on the fuel injector 11 with highly pressurized fuel. The throttle restriction 4, the high-pressure pump unit 3, the pressure sensor 6, the pressure relief valve 7, and the high-pressure lines 9 and 10 to the cylinder banks of the engine essentially correspond to the components of the injection system that has already been depicted in FIG. 1.

By contrast with the exemplary embodiment of the injection system for larger autoignition internal combustion engines shown in FIG. 1, according to the schematic diagram shown in FIG. 7, the inlet throttles 37 do not act directly on the fuel injectors 11 via the conduits 44 extending in the head regions 15 of the injectors, between the line segments 17, 17.1, and 1.2. A high-pressure line connecting piece 100 extends between the inlet throttles 37, which are preferably embodied with a geometry shown in enlarged fashion in FIG. 2*a*. This high-pressure line connecting piece 100, essentially embodied as a tubular body with a thick wall, acts on the fuel injector 11 with highly pressurized fuel.

FIG. 8 shows a schematic diagram of the high-pressure connecting piece, which extends between the conduit 44 and the injector body 20 of the fuel injector 11 shown in FIG. 7.

It is clear from the depiction in FIG. 8 that analogous to the depiction of the exemplary embodiments according to FIGS. 2, 3, 4, and 5, the inlet throttle 37 is acted on by means of a conduit 44 that is embodied with a conduit cross section 45. High-pressure line segments 17.2 and 17.1—indicated here with dashed lines—are connected to this conduit via the connecting points shown by way of example in FIG. 5. The inlet throttle 37, which is preferably embodied with a throttle geometry 37.1 depicted in FIG. 2*a*, acts on the high-pressure connecting piece 100, which has another accumulator chamber 36.1, which is embodied essentially symmetrical to the axis 103 of the high-pressure connecting piece 100. The high-pressure connecting piece 100 extends for a length 101 between the head region 15 and the injector body 20 of the fuel injector 11. Fuel travels from the conduit 44 via the inlet throttle 37 into the additional accumulator chamber 36.1 inside the high-pressure line connecting piece 100, flows through an L-shaped line connection 104, into the interior of the accumulator chamber 36 in the upper region of the injector body 20 of the fuel injector 11. The fuel injector 11 includes a union nut 39 schematically depicted here, which connects the injection nozzle part 16 to the injector body 20 by means of a screw connection. The high-pressure line connecting piece 100, including an additional accumulator chamber 36.1 that is essentially tubular, is attached to the injector body 20 of the fuel injector 11 at a connecting point 102 embodied as a screw connection.

On the one hand, the exemplary embodiment shown in FIG. 8 permits an improved flexibility in the installation of the fuel injectors 11 and in the line connection between the line segments 17.1, 17.2 and the injector body 20. On the other hand, the volume of the accumulator chamber 36 can be increased due to the integration of the additional accumulator chamber 36.1 into the interior of the high-pressure line connection 100.

Figure 9:
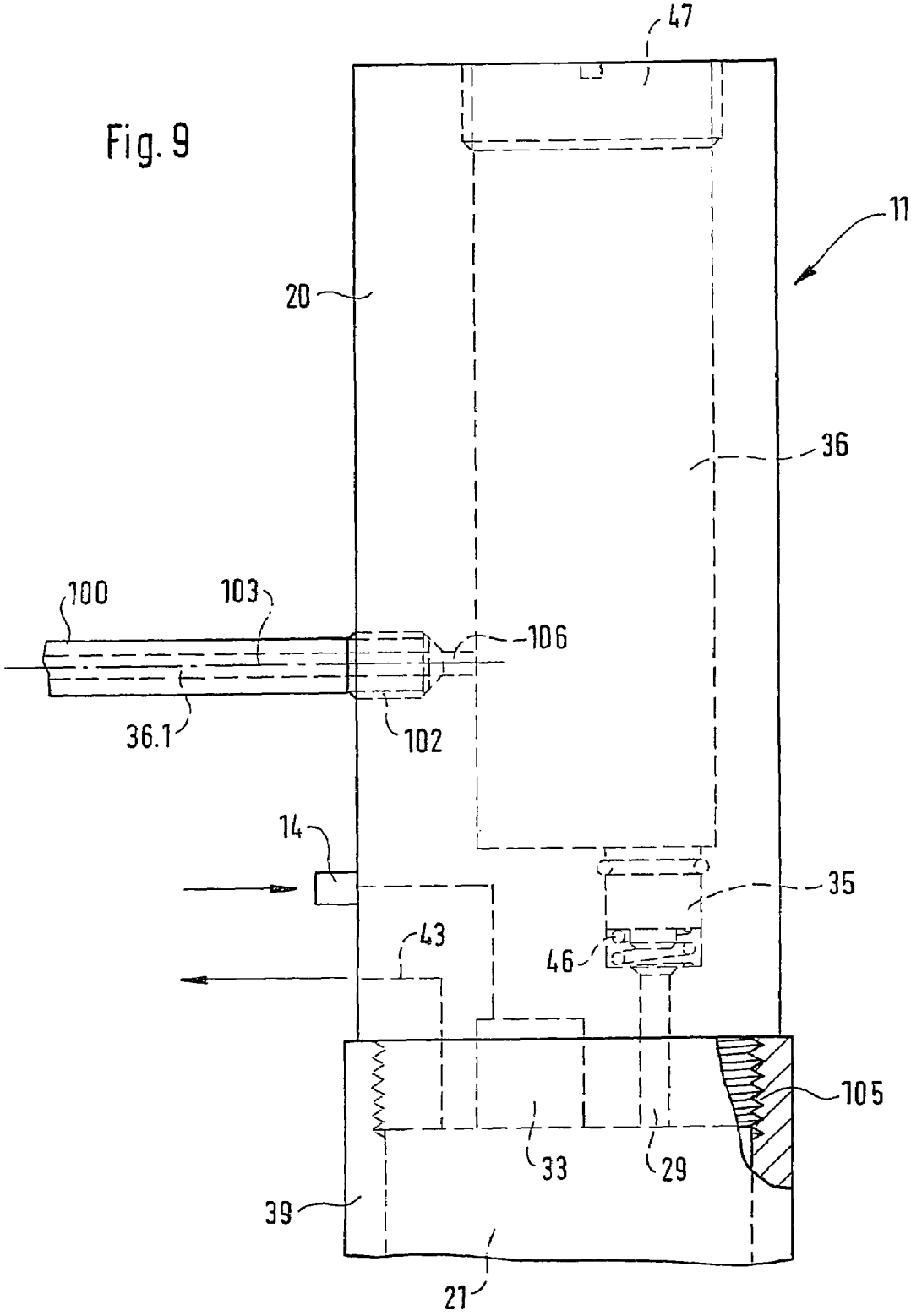
FIG. 9 shows other components installed in a fuel injector, beneath the accumulator chamber 36 that is integrated into it.

FIG. 9 shows other installed components in a fuel injector, beneath the accumulator chamber that is integrated into the injector body of the embodiment show in FIGS. 7 and 8.

The additional accumulator chamber 36.1, which is acted on with highly pressurized fuel via the inlet throttle 37, not shown in FIG. 9, and is embodied in the high-pressure line connecting piece 100, extends essentially coaxial to the symmetry axis 103 of the high-pressure line connecting piece. This connecting piece is preferably screwed into the side of the injector body 20 of the fuel injector 11 by means of a screw-mounting thread 102. In the vicinity of a transition bore 106, the fuel volume flows out of the additional accumulator chamber 36.1 into the accumulator chamber 36 on the interior of the injector body 20 of the fuel injector 11. The accumulator chamber 36 inside the injector body 20 is closed in a pressure-tight manner at the top of the fuel injector 11 by means of a screwed-in stopper 47. The flow limiter 35 is disposed underneath the accumulator chamber 36 in the injector body 20 and is prestressed by means of a spring element 46 analogous to the flow limiters 35 depicted in FIGS. 5 and 2. The high-pressure line 29 extends underneath the flow limiter 35 and, as shown in the depiction according to FIG. 2, acts on a nozzle needle chamber 40 inside the fuel injector 11 with highly pressurized fuel via a control part 21 and an intermediate plate 22. The reference numeral 33 indicates a closing spring, which acts on an electromagnet 34 (not shown in FIG. 9). The nozzle-retaining nut 39 connects the control part 21 in a pressure-tight, centered manner to a screw connection 105 in the lower region of the injector body 20 of the fuel injector 11. The reference numeral 43 indicates the leakage conduit, while the reference numeral 14 indicates the triggering mechanism of the electromagnetic valve 34 not shown in FIG. 9, of which the closing spring 33 is only schematically depicted. In comparison to the exemplary embodiment according to FIG. 2, the manner shown in FIG. 9 of acting on the accumulator chamber 36 indirectly by means of an additional accumulator chamber 36.1 that is integrated into the interior of a high-pressure line connecting piece 100 makes it possible to reduce the structural height of the injector, which as a rule must be accommodated in the cylinder head region of autoignition internal combustion engines, which improves its installation possibilities in the cylinder head region. The exemplary embodiment shown in FIGS. 5 and 6, with the accumulator disposed in the lateral direction 48, likewise significantly improves the installation height in a fuel injector, thus permitting a more flexible injector design and in particular, permitting the fuel injectors 11 proposed according to the invention, which have an accumulator chamber 36 and an additional accumulator chamber 36.1 in a high-pressure line connecting piece 100, to be integrated into the cylinder head region in a considerably improved fashion.

The foregoing relates to preferred exemplary embodiments of the invention, it being understood that other variants and embodiments thereof are possible within the spirit and scope of the invention, the latter being defined by the appended claims.

What is claimed is:

1. A fuel injection system for use in internal combustion engines, that has delivery units (2, 3) for delivering fuel from a fuel reservoir (1) in order to supply at least one high-pressure line (9, 10) to the cylinders of the engine, the system comprising the at least one high-pressure line (9, 10) supplying a plurality of fuel injectors (11), which include an injector nozzle (16) that supplies fuel to a combustion chamber of the engine, the at least one high-pressure line (9, 10) including line segments (17, 17.1, 17.2) that connect the individual fuel injectors (11) to one another, the fuel injectors each having an accumulator chamber (36, 36.1) integrated into an injector housing (20), wherein each fuel injector (11) includes a head region (15) having a conduit (44) extending through the head region, the conduit (44) having an inlet connected to one line segment and an outlet connected to another line segment, and wherein the head region (15) of the fuel injector (11) is embodied as an insert piece (51), which is connected to the injector body (20) in a sealed fashion.

2. The injection system according to claim 1, wherein the accumulator chamber (36) is disposed in the head region (15) of the injector body (20).

3. The injection system according to claim 1, wherein the accumulator chamber (36) is disposed in the longitudinal direction in the injector body (20).

4. The injection system according to claim 2, wherein the accumulator chamber (36) is disposed in the longitudinal direction in the injector body (20).

5. The injection system according to claim 2, wherein the accumulator chamber (36) is disposed in the lateral direction in the injector body (20).

6. The injection system according to claim 1, wherein the accumulator chamber (36) in the injector body (20) is connected to the line segments (17, 17.1, 17.2) via a high-pressure line connecting piece (100) that contains an additional accumulator chamber (36.1).

7. The injection system according to claim 1, wherein a connection line with an inlet throttle (37) to the accumulator chamber (36) branches off in the head region (15) of the fuel injector (11).

8. The injection system according to claim 1, further comprising a spring-loaded flow limiter (35) and a high-pressure fuel line (29) leading to a nozzle needle chamber (40), the flow limiter (35) being connected downstream of the accumulator chamber (36) and upstream of the high pressure fuel line (29).

9. The injection system according to claim 1, wherein the injector (11) is embodied in a modular fashion, including an injector body (20), a control part (21), an intermediate plate (22), and an injector nozzle (16).

10. The injection system according to claim 9, further comprising a control chamber (27), and throttle elements (28, 30) that exert pressure on the control chamber (27) or relieve the pressure in it, the throttle elements (28, 30) being embodied in the intermediate plate (22).

11. The injection system according to claim 10, wherein the control chamber (27) is delimited by a sleeve (25), a nozzle needle (23) that can be moved in relation to the sleeve (25) and the intermediate plate (22).

12. The injection system according to claim 1, wherein the volume of the accumulator chamber (36) corresponds to 50 to 80 times the maximal injection quantity.

13. The injection system according to claim 7, wherein the inlet throttle (37) associated with the accumulator chamber (36) is designed so that the pressure level in the accumulator chamber (36) of the fuel injector (11) corresponds to a pressure level prevailing in a pressure accumulator (5) integrated into one of the delivery units (2, 3).

* * * * *